US008994559B1

(12) United States Patent
LaRocco

(10) Patent No.: US 8,994,559 B1
(45) Date of Patent: Mar. 31, 2015

(54) SIGNAL PYLON

(71) Applicant: Michael A LaRocco, Galien, MI (US)

(72) Inventor: Michael A LaRocco, Galien, MI (US)

( * ) Notice: Subject to any disclaimer, the term of this patent is extended or adjusted under 35 U.S.C. 154(b) by 54 days.

(21) Appl. No.: 13/968,250

(22) Filed: Aug. 15, 2013

Related U.S. Application Data

(60) Provisional application No. 61/683,341, filed on Aug. 15, 2012.

(51) Int. Cl.
*G08G 1/095* (2006.01)
*E01F 9/016* (2006.01)

(52) U.S. Cl.
CPC ..... *E01F 9/0165* (2013.01)
USPC ..... 340/907; 340/908; 404/6

(58) Field of Classification Search
USPC ..... 340/907, 908, 908.1, 471; 116/63 R; 404/6
See application file for complete search history.

(56) References Cited

U.S. PATENT DOCUMENTS

| | | | | |
|---|---|---|---|---|
| 3,872,294 | A * | 3/1975 | O'Toole | 362/85 |
| 6,243,958 | B1 * | 6/2001 | Ringley, Jr. | 116/209 |
| 6,556,147 | B1 * | 4/2003 | Fisher et al. | 340/908 |
| 6,626,606 | B1 * | 9/2003 | Johnson | 404/6 |
| 7,278,769 | B2 * | 10/2007 | Dick | 362/553 |
| 2007/0290887 | A1 * | 12/2007 | Pleasanton | 340/908 |

* cited by examiner

*Primary Examiner* — John A Tweel, Jr.
(74) *Attorney, Agent, or Firm* — Botkin & Hall, LLP

(57) ABSTRACT

A pylon is provided for providing visual signals to race participants. The pylon includes a base. A shell is carried on the base. The shell is formed having an outer wall surrounding an internal chamber. The internal chamber includes a wedge-shaped portion which carries a wedge-shaped luminaire. An upwardly-extending tube is carried by the base. The tube is nested within the internal chamber and carries the shell. A power source is provided which provides electricity to the luminaire. A wireless transmitter is provided which is used by a user to turn the luminaire on and off, which luminaire provides visual signals to the race participants.

17 Claims, 6 Drawing Sheets

FIG.6
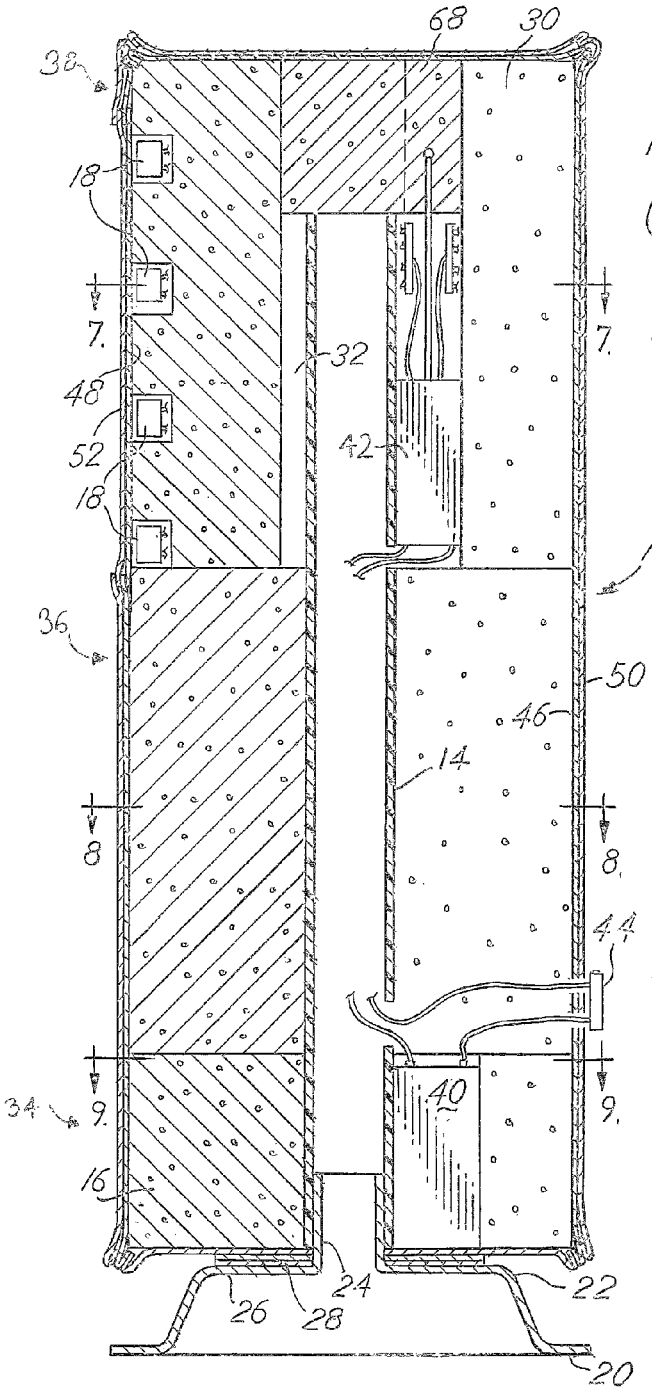
FIG.7
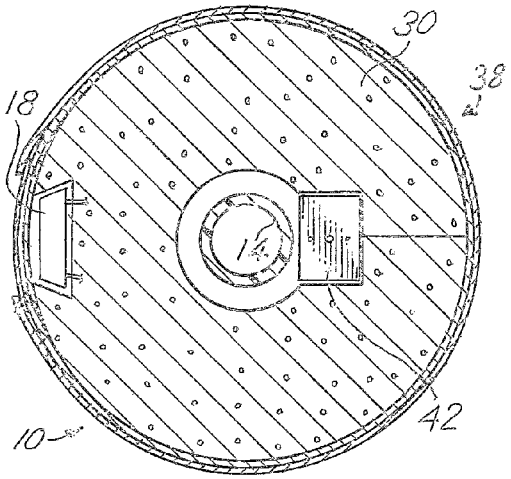
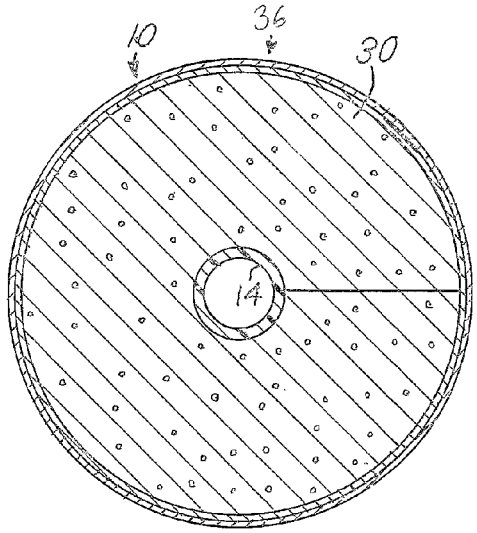
FIG.8

SIGNAL PYLON

CROSS-REFERENCE TO RELATED APPLICATION

This patent application claims priority from U.S. Provisional Application No. 61/683,341, filed Aug. 15, 2012, which application is hereby incorporated in its entirety by reference.

BACKGROUND OF THE INVENTION

In motorsports various visual signals are used to provide indications to the racers of the status of the race, such as signaling the start of the race, signaling caution, signaling a final lap, and other similar signals. Traditionally, these signals have been provided by colored flags waved by flagmen. To be effective, the flagmen need to be positioned proximate the racing surface so that the flag is readily visible to the racers. With the flagmen positioned proximate to the racing surface, the risk of injury to the flagmen increases. As such, an improved signaling system is needed.

SUMMARY OF THE INVENTION

The present disclosure describes a signaling system which provides information to racers regarding the status of the race, such as when the race is under caution. The present disclosure describes a pylon which is positionable on or near the racing surface, which pylon includes a series of lights that provide a visual indication informing the racers of the current status of the race, such as when the race is beginning, is under caution, or any number of other signals related to the race. The pylon is formed in such a way that it is sufficiently durable, that it can withstand contact with a racing vehicle without being excessively damaged, and is sufficiently yielding that it will minimize damage to a racing vehicle or injury to a racer on impact. The pylon is remotely operated such that a user need not be in the immediate proximity of the pylon to operate the signal system, thereby increasing the safety of the user.

BRIEF DESCRIPTION OF THE DRAWINGS

A preferred embodiment of this invention has been chosen wherein:

FIG. 6 is a sectional side view of the pylon of FIG. 1;

FIG. 7 is a sectional view of the pylon of FIG. 6 as taken along the line 7-7;

FIG. 8 is a sectional view of the pylon of FIG. 6 as taken along the line 8-8;

DESCRIPTION OF THE PREFERRED EMBODIMENT

Figure 1:
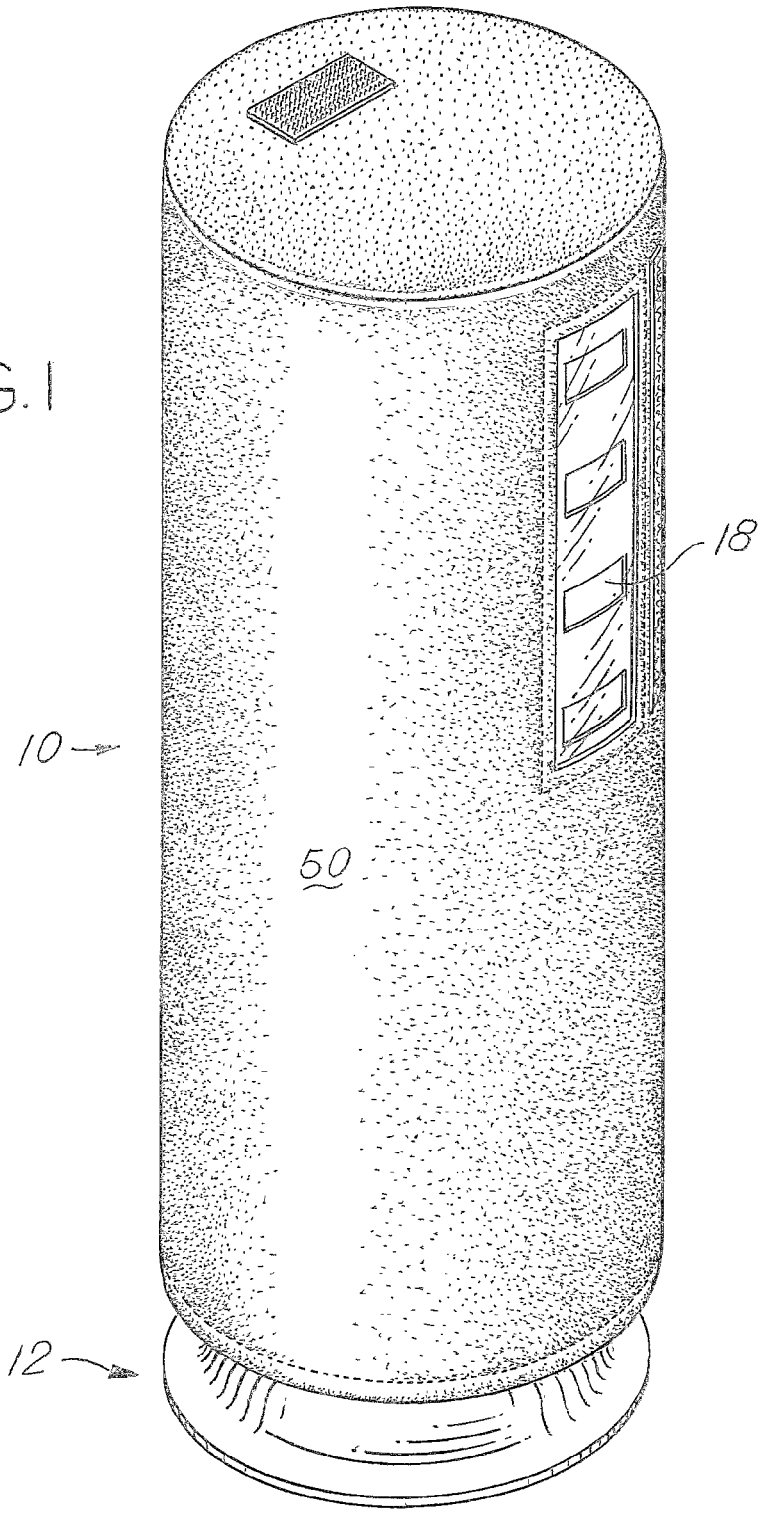
FIG. 1 is a perspective view of the pylon of the present disclosure.

The present disclosure describes a pylon 10 suitable for providing a visual signal. In one application, the visual signal provided by the pylon 10 is used to inform racers of the current status of a race. The pylon 10 is formed from two constituent sections: a support structure and a body. The support structure is defined by a base 12 and a tube 14 extending upwardly from the base. The body is defined by a shell 16, and constituent electronic parts including one or more luminaires 18. The tube 14, as described in greater detail below, is adapted for supporting the shell 16 in a generally upright position above the base 12, such that together the support structure and the body form a free-standing pylon.

Figure 2:
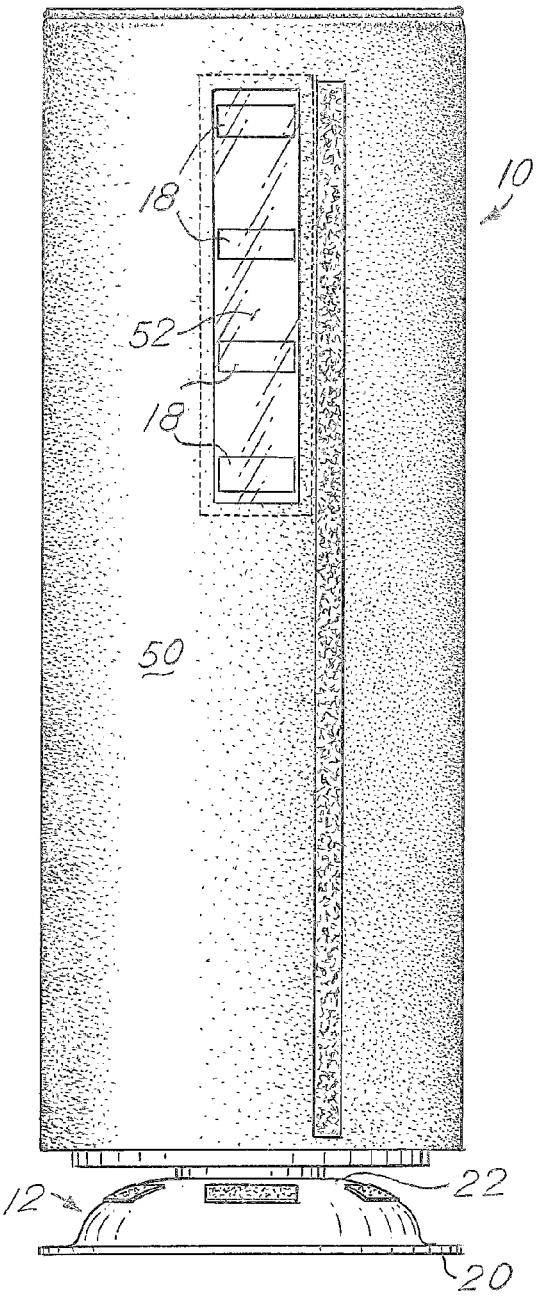
FIG. 2 is a front view of the pylon of FIG. 1.
Figure 3:
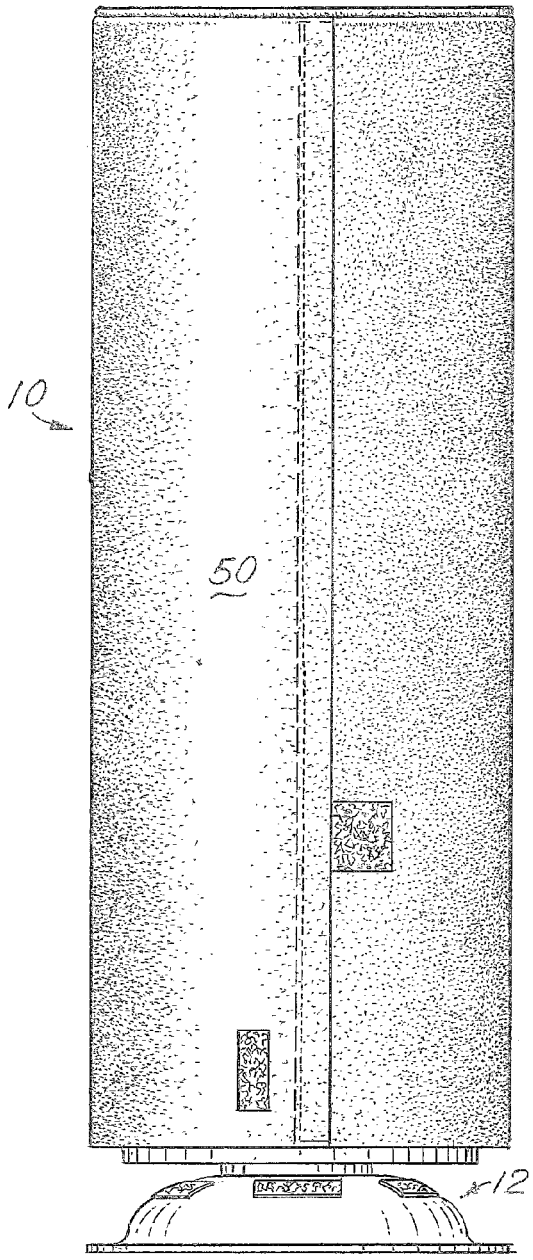
FIG. 3 is a back view of the pylon of FIG. 1.
Figure 4:
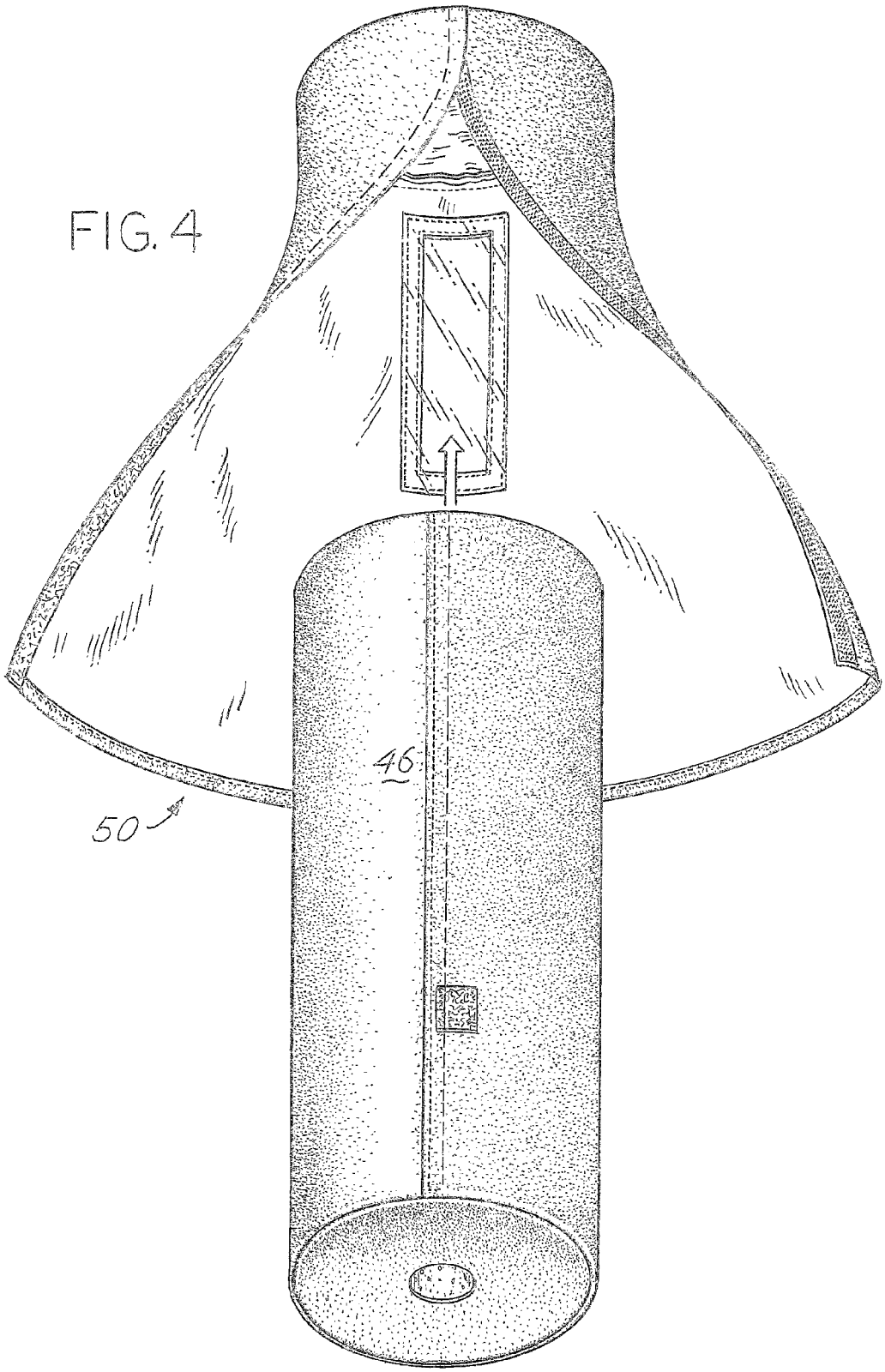
FIG. 4 is an exploded view of the outer cover and the pylon encased in the inner cover.

The base 12 serves to hold the pylon 10 in an upright, free-standing, position. As shown in FIGS. 1-3, the base 12 defines the bottom end of the pylon 10 and supports the remainder of the pylon 10. The base 12 has a wide lower end 20 and tapers to a narrower upper end 22. The lower end 20 serves as the base, or foot, of the pylon 10. As shown in FIG. 6, the tube 14 extends from the upper end 22 of the base 12 and supports the shell 16. A support member 24 extends upwardly from the upper end 22 of the base 12, and the tube 14 sheathes around the support member 24, such that an interference fit is formed between the outer surface of the support member 24 and the inner surface of the tube 14 to hold the tube 14 in an upright position. The upper end 22 of the base 12 also includes a flat section 26 on which the shell 16 rests. The flat section 26 is generally parallel with the lower end 20 and is spaced radially outwardly from the support member 24. In one configuration, an adhering device 28, such as a hook-and-loop fastener is positioned on the flat section 26 in order to aid in retaining the shell 16 in contact with base 12 and to restrict rotation of the shell 16 about the tube 14. In one configuration, the base 12 is weighted so as to provide ballast to the pylon 10 (this ballast could come from the weight of the materials of the base 12, or the base 12 could be hollow and filled with water, sand or other suitable medium to provide ballast).

Figure 5:
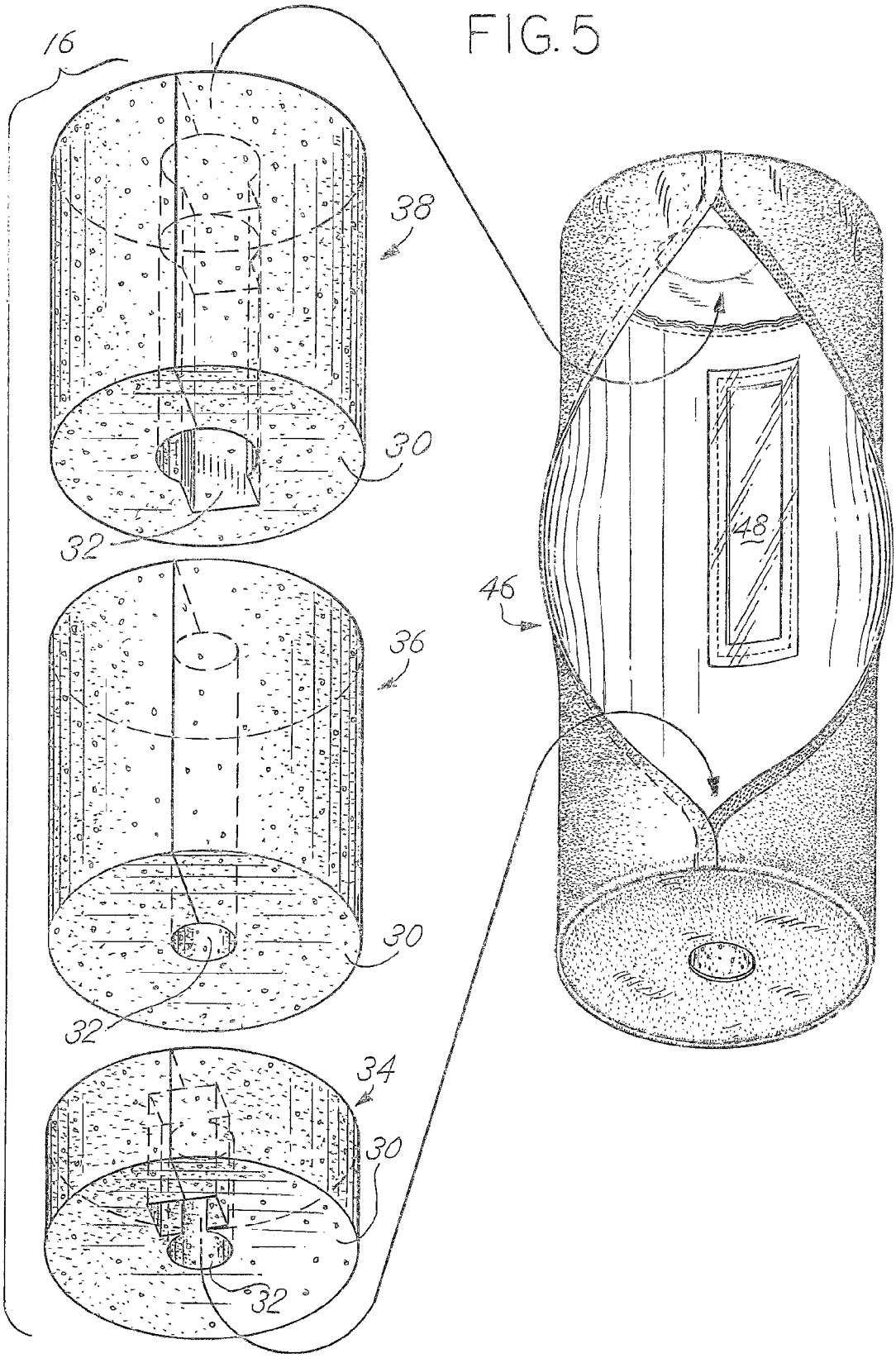
FIG. 5 is an exploded view of the pylon showing the constituent parts of the shell and the inner cover.
Figure 9:
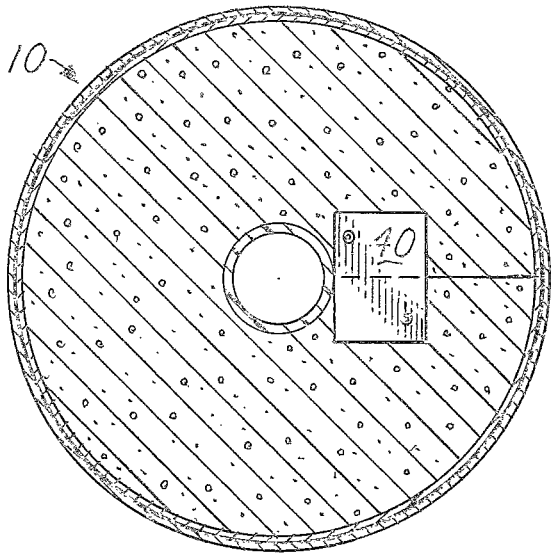
FIG. 9 is a sectional view of the pylon of FIG. 6 as taken along the line 9-9.

Referring now to FIG. 5, the shell 16 is a generally cylindrically-shaped column defined by a wall 30 which defines an inner chamber 32. As shown in FIG. 5, in one configuration, the shell 16 is formed from three separate sections, a first section 34, a second section 36, and a third section 38 which are stacked together one on top of one another, with first section 34 on the bottom and third section 38 on the top, to form the shell 16 as shown in FIGS. 5 and 6. Forming the shell 16 in separate sections 34, 36, 38 aids in the machining process which forms the various areas of the chamber 32. Referring to the first section 34, the inner chamber 32 is shaped as a space defined by the intersection of a cylinder and a cuboid, which forms a keyhole-type shape where the cylinder-shaped section is sized to encircle the tube 14 and the cuboid-shaped section is sized to house a power supply 40, such as a battery. Referring to the second section 36, the inner chamber 32 is cylinder-shaped and sized to encircle the tube 14. Referring to the third section 38, the inner chamber 32 optionally includes a series of sub-chambers to accommodate the tube 14, a transmitter 42 and one or more luminaires 18, as shown in cross-section in FIG. 6. The sub-chamber which houses the transmitter 42 is a cuboid which is shaped to closely surround the transmitter in order to retain the transmitter in place within the chamber 32 and includes a smaller cylindrical offshoot to house an antenna which extends from the transmitter 42. The sub-chamber which holds one of luminaries 18 is shaped generally as a trapezoidal prism, where one of the rectangular faces of the prism forms an opening in the wall 30 to allow luminaire 18 to emit light outwardly from the shell 16. FIG. 7 shows a top view of the third section 38 showing the sub-chamber which houses luminaire 18 and shows the trapezoidal-shape of the sub-chamber. The luminaire 18 is also shaped as a trapezoidal prism and nests tightly within the luminaire sub-chamber of the chamber 32, wherein the width of the luminaire 18 increases as spaced away from the light-emitting end of the luminaire. The trapezoidal shape of the sub-chamber fits tightly around luminaire 18 and the angled, or wedge-shaped, sides of the trapezoid serve to hold the luminaire in the chamber; due to the angles of the sides of the sub-chamber, and the corresponding angled sides of the luminaire, the luminaire is restrained from exiting out of the opening of the wall 30 through which the luminaire emits light. The trapezoidal sub-chambers are connected to the other portions of the inner chamber 32 by openings or pathways which carry the wiring which connects the luminaires 18 to the other components of the electrical system, such as the transmitter 42 and the power supply 40. The inner chamber 32 of the upper section 38 also includes a cylinder-shaped area for housing the upper section of the tube 14 and a cuboid area which extends from the cylinder-shaped area which houses the transmitter 42. The cylinder-shaped area and cuboid-shaped area together define a keyhole-shaped area. In sum, each of the sub-chambers described as parts of shell sections 34, 36, 38 together forms the chamber 32 and house the constituent elements. A plug 68 is removably situated at the keyhole-shaped area formed in the upper end of the third section 38 of the shell 16 and caps the top end of the chamber 32. The plug 68 is removable to allow access to the chamber 32 and the electrical system. The plug 68 is keyhole-shaped so as to fit snuggly in a keyhole-shaped opening above the chamber 32. The plug 68 sits flush within the shell 16 such that the pylon 10 has a flat upper surface.

Referring now to the wiring system of the pylon 10, the power supply 40 provides power to both the transmitter 42 and luminaire 18. The transmitter 42 communicates wirelessly with a remote transmitter, such as a remote control (not shown) operated by a user; as such a user is able to remotely operate the systems within the pylon 10, such as turning the luminaires on and off, changing the color of the light emitted from the luminaires, and other similar features. The power supply 40 is also electrically connected to a circuit breaker, or switch 44, which is held on the outside of the pylon 10. The switch 44 is used to turn the systems held within the pylon 10 on and off such as by opening the circuit between the power supply 40 and the transmitter 42 and/or opening the circuit between the power supply 40 and the luminaire 18.

The wiring system of the pylon 10 is adapted to perform many functions which provide signals to racers in a safe manner. One such feature is that each luminaire 18 is controllable independently of the other luminaires. Another such feature is that each luminaire 18 can be toggled to emit different colors, such as green to start the race or yellow for caution, or any other color, or color combination as is suitable given the race conditions. A similar feature is that each luminaire 18 is suitable for displaying a steady stream of light, or an intermittent or flashing light as directed by the user. The transmitter 42 is suitable for communicating with a remote system, such that the electrical system can be activated and modified from a safe distance. In one configuration, each pylon corresponds to a user who has a remote control for controlling a single pylon. In another configuration, in addition to each individual user, there is also a master control capable of controlling each pylon for a given race. In a further configuration, the transmitter 42 of one pylon will be able to relay a signal to the transmitter of another pylon, such that when a feature is activated or deactivated on one pylon, the other pylon responds (for example, if one pylon is ordered to display a "caution" signal, the other pylons will also receive a signal to display a "caution" signal). In one configuration, the above features of the wiring system are effectuated by a computer board integrated with the transmitter 42, which board translates a received wireless signal to a signal which switches the luminaires 18 on or off, changes their color, or performs other functions.

The electrical system described herein is designed to withstand the abuse of a race, such that when the pylon 10 is impacted by a vehicle, the wiring system will remain protected. One way the electrical system is protected is by being housed within the shell 16. The wall 30 of the shell 16 is preferably formed from foam, such that it serves as padding for the electrical system. Another way the electrical system is protected during impact is through use of extra wiring. The lengths of wire used to connect various components of the electrical system, such as the wire which connects the transmitter 42 to the power supply 40, are longer than are required to span the distance between them. The wire is preferably 1.5-5 times longer than the distance between the components of the electrical system, more preferably 2-3 times longer than the distance between the components of the electrical system. As such, if the pylon breaks or ruptures on impact, the extra lengths of wire will unwind and allow the parts of the pylon to move away from one another without straining the wire, thereby lowering the chance the wiring will be damaged during an impact. A further way the electrical system is protected during impact is through use of quick-disconnect wiring connections, such that when a wire is pulled in tension, the quick-disconnect wiring connections will readily detach from the connected part (such as the luminaire 18, the transmitter 42 or the power supply 40); the wiring will readily detatch rather than break, stretch or otherwise damage the wire. In this way, even if various parts of the electrical system move away from one another during impact a distance longer than the extra span of wire, the wire will detach rather than break.

The shell 16 is encased by an inner cover 46 as shown in FIG. 5. The inner cover 46 surrounds the shell 16, and is made of a sufficiently durable material to protect the shell 16 and the associated parts should the pylon 10 be impacted, such as by a racer. The inner cover 46 provides at least two types of protection: first, the inner cover 46 serves to contain the shell 16 and the associated parts at impact, and second, the inner cover 46 helps protect the shell 16 from cuts or scrapes and similar damage during impact. The inner cover 46 includes a window 48 which allows the light emitted from the luminaires 18 to pass through the inner cover 46. As shown in FIG. 5, the inner cover 46 includes an opening through which the shell 16 is inserted into the inner cover 46. The inner cover 46 also includes an opening above the plug 68, such that the plug 68 can be removed from the pylon 10 without removing the inner cover 46. Removal of the plug 68 allows access to the various components carried within the pylon 10.

An outer cover 50 encases the inner cover 46. The outer cover 50 provides a second level of protection to the shell 16. It is contemplated that the outer cover 50 will be adorned with logos, designs or advertising materials. The outer cover 50 includes fasteners and openings whereby the outer cover 50 is readily removable and replaceable from the pylon 10 so as to allow ready customization of the outer appearance of the pylon 10. The outer cover 50 also includes a window 52 which, when both the inner cover 46 and the outer cover 50 are installed on the shell 16, aligns with the window 48 of the inner cover 46 to allow light to emit from luminaire 18 to the exterior of the pylon 10.

Figure 10:
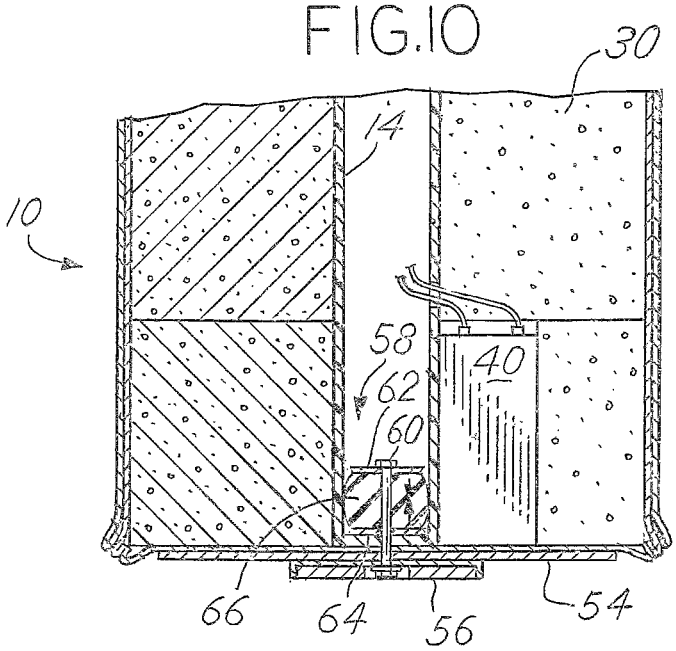
FIG. 10 is a sectional view of an alternative base configuration of the pylon.

Referring now to FIG. 10, in one configuration the support structure incorporates a magnetic base defined by a magnet 54, a support plate 56, an anchor 58 and a fastener 60. The anchor 58 forms an interference fit within the tube 14 and the fastener 60 sandwiches the magnet 54 between the anchor 58 and the support plate 56, thereby holding the magnet 54 to the bottom end of the tube 14. The support plate 56 is essentially a washer positioned below the magnet 54, and the support plate 56 forms a compression fit against the magnet 54 by the fastener 60. The magnet 54 is disc-shaped and includes an aperture which allows the fastener 60 to pass through the magnet. The anchor 58 is defined by an upper plate 62, a lower plate 64 and a compression member 66, where compression member is sandwiched between the upper plate 62 and the lower plate 64. Each of the upper plate 62, the lower plate 64 and the compression member 66 include apertures passing therethrough for accepting the fastener 60. When the fastener 60 is tightened, the upper plate 62 advances in the direction of the support plate 56, thereby compressing the compression member 66, which in turn causes the compression member 66 to deform in a way that causes the radius of the compression member 66 to increase such that the outer wall of the compression member 66 forms an interference fit with the inner wall of the tube 14. With the magnetic base fitted to the lower end of the pylon 10, the pylon is held at a specific location on a racing surface by driving a ferrous spike, or similar magnetic object, into the racing surface and positioning the pylon above the spike such that the magnet is held in position by magnetic attraction to the spike.

One feature that helps prevent damage to the pylon 10 is that when the pylon 10 is impacted it is freely movable, such that on impact the pylon will translate the force of impact into motion. In the configuration with the ballast base, the base is not attached to the track in any way, and is held in place only by gravity. In this embodiment, when the pylon 10 is impacted, the pylon is freely movable. In the configuration with the magnetic base, the base is held by magnetic attraction to a spike driven into the track. In this embodiment, when the pylon 10 is impacted, the pylon is designed to come loose from the track in one of two ways. First, the magnet is designed to be strong enough to hold the pylon in place, but weak enough to come free from the spike when the pylon is impacted. Second, the anchor holds the magnetic base to the tube by an interference fit that is designed to release when a sufficient force is applied to the pylon. In this way, when experiencing an impact, either the magnet or the anchor will give way, whichever requires less force, to allow the pylon to freely move relative the racing surface.

It is understood that while certain aspects of the disclosed subject matter have been shown and described, the disclosed subject matter is not limited thereto and encompasses various other embodiments and aspects. No specific limitation with respect to the specific embodiments disclosed herein is intended or should be inferred. Modifications may be made to the disclosed subject matter as set forth in the following claims.

What is claimed is:

1. A pylon comprising:

a base;

a shell; said shell formed having an outer wall surrounding an internal chamber; said internal chamber including a wedge-shaped portion;

a luminaire nested in said wedge-shaped portion of said internal chamber;

an upwardly-extending tube is carried by said base, said tube is nested within said internal chamber, said tube carries said shell;

a power source providing electricity to said luminaire;

a wireless transmitter in communication with said luminaire;

a first jacket encasing said shell;

a second jacket surrounding said first jacket.

2. The pylon of claim 1, and said power source is carried within said internal chamber.

3. The pylon of claim 2, and said wireless transmitter is carried within said internal chamber.

4. The pylon of claim 1, and said luminaire includes a light-emitting end, said luminaire is shaped as a trapezoidal prism having a width which increases as spaced from the light-emitting end.

5. The pylon of claim 1, and said shell is formed from a first section, a second section, and a third section vertically stacked together, each of said first, second and third sections having sub-chambers formed therein which together define said internal chamber.

6. The pylon of claim 1, and a keyhole-shaped opening formed in the upper surface of said first section, and a keyhole-shaped plug removably carried in said keyhole-shaped opening.

7. The pylon of claim 1, and a switch electrically connected to said power source and disposed on said second jacket.

8. The pylon of claim 1, and said first jacket including a window, and said second jacket including a window, said luminaire is aligned with both said window of said first jacket and said window of said second jacket.

9. The pylon of claim 1, and said luminaire is electrically connected to said power source by a wire, said wire being at least twice as long as the distance between said luminaire and said power source.

10. The pylon of claim 9, and said wire having quick-disconnect connectors.

11. The pylon of claim 1, and a hook and loop fastener disposed on a top surface of said base and a corresponding hook and loop fastener disposed on a bottom surface of said second jacket.

12. The pylon of claim 1, and said base having a bottom surface and a top surface, said bottom surface being wider than said top surface, a support member extends upwardly from said top surface, said tube sheathes around said support member and is carried thereon.

13. The pylon of claim 1, and said base including a magnet, said pylon used in combination with a racing surface, said racing surface including a magnetic portion at which said magnet is positioned.

14. The pylon of claim 13, and a compressible member joined to said base, said compressible member carried within said tube, said compressible member forms an interference fit with said tube.

15. The pylon of claim 14, said compressible member expands outwardly against said tube as said fastener is tightened.

16. A pylon comprising:

a base;

a shell; said shell formed having an outer wall surrounding an internal chamber; said internal chamber including a wedge-shaped portion; and a wedge-shaped luminaire nested in said wedge-shaped portion of said internal chamber.

17. A pylon comprising:

a base; said base including a magnet, said pylon used in combination with a racing surface, said racing surface including a magnetic portion at which said magnet is positioned;

a tube extending upwardly from said base; said tube carrying a shell;

a compressible member joined to said base, said compressible member carried within said tube, said compressible member forms an interference fit with said tube.

* * * * *